United States Patent [19]

Green, Jr.

[11] 4,436,100

[45] Mar. 13, 1984

[54] SMOKE GENERATOR

[76] Inventor: William D. Green, Jr., 8906 Camden St., Alexandria, Va. 22308

[21] Appl. No.: 251,074

[22] Filed: Apr. 6, 1981

Related U.S. Application Data

[63] Continuation-in-part of Ser. No. 104,701, Dec. 17, 1979, Pat. No. 4,259,970.

[51] Int. Cl.[3] ..... A24F 47/00

[52] U.S. Cl. ..... 131/330; 110/118; 99/482; 131/330

[58] Field of Search ..... 131/329, 330, 185; 99/474, 481, 482; 110/108, 118

[56] References Cited

U.S. PATENT DOCUMENTS

| | | | |
|---|---|---|---|
| 1,174,088 | 3/1916 | Mulock | 110/118 |
| 2,960,981 | 11/1960 | Robertson | 131/330 X |
| 3,785,304 | 1/1974 | Stookey | 110/118 X |
| 3,804,104 | 4/1974 | Fariello | 131/185 X |
| 3,889,690 | 6/1975 | Guarnieri | 131/330 X |
| 4,164,230 | 8/1979 | Pearlman | 131/330 |
| 4,270,464 | 6/1981 | Keres | 99/482 X |

*Primary Examiner*—Stephen C. Pellegrino
*Attorney, Agent, or Firm*—Jacob Shuster

[57] ABSTRACT

The housing of a smoke generator is provided with an outlet passage conducting a blower induced flow of particulate material from a hopper. An inflow of air is conducted to the blower separate from the material through a conduit extending through the hopper. The material is comminuted before entering the blower and is discharged by the blower into the outlet passage to accumulate on the upstream side of a screen which also forms a burner element activated by means of a switch to effect combustion of the accumulated material. The smoke so produced is displaced through the screen under the pressure produced in the outlet passage by the blower.

16 Claims, 13 Drawing Figures

SMOKE GENERATOR

BACKGROUND OF THE INVENTION

This invention relates to a smoke generating and dispensing device of the type disclosed and claimed in my prior copending application, Ser. No. 104,701, filed Dec. 17, 1979, now U.S. Pat. No. 4,259,970, with respect to which the present application is a continuation-in-part.

According to my prior copending application the disclosure of which is hereby incorporated by reference, a smoke generating and dispensing device includes a housing having a hopper within which material is stored, a smoke outlet, means for conveying the material from the hopper to the upstream side of a gas permeable screen at which the material undergoes combustion by activation of an electrical burner element. The products of such combustion pass through the screen as smoke for discharge from the outlet. In order to condition the material for combustion and conveyance to the combustion zone on the upstream side of the screen in the air flow stream produced by a blower, the material is comminuted as it enters the blower by means of a rotating cutter blade closely positioned above an apertured plate fixed to the housing between the hopper and the blower chamber. Manually operable means is also provided to control the feed of material and inflow of ambient air.

The apparatus disclosed in my prior copending application is sometimes unreliable in operation because of the action of the material comminuting elements. The flow of material past the comminuting elements is often erratic and the particles of the comminuted material non-uniform in size. Also, the complexity of the apparatus heretofore disclosed in my prior copending application made assembly and disassembly somewhat difficult for repair and cleaning purposes.

It is therefore an important object of the present invention to provide a smoke generating and dispensing device that is more reliable in operation and avoids the aforementioned drawbacks associated with the device disclosed in my prior copending application.

SUMMARY OF THE INVENTION

In accordance with the present invention, a vertically elongated, cylindrical housing encloses a blower motor within a lower end portion, a hopper or material holding chamber at its upper end portion and a blower chamber intermediate the hopper and motor. The housing has an intermediate, laterally extending formation enclosing an outlet passage that communicates tangentially with the blower chamber. By means of such a housing configuration, the device may be readily grasped in the hand of a user without interfering with the outflow of smoke as well as to direct the smoke in any desired direction. An insert fitted into the laterally extending formation of the housing mounts a gas permeable screen which also constitutes an electrical burner element blocking the outflow of material from the outlet passage forming a combustion chamber within which the material accumulates and smoke generated on the upstream side of the screen. When activated, the the burner element causes combustion of the accumulated material producing smoke displaced through the screen under the pressure developed in the outlet passage by operation of the blower. Pushbutton switches mounted on the laterally extending formation of the housing enables the user to conveniently control operation of the burner element and the blower motor.

The upper end portion of the housing is closed by an end wall from which an inflow conduit extends through the hopper to the blower chamber partitioned from the hopper by a barier which includes a slotted plate or disk rotatable with the fan rotor of the blower within its cylindrical chamber. The slotted plate constitutes one of the comminuting elements in sliding contact with a non-rotatable comminuting element. Guide slots formed in the housing and at the lower end of the inflow conduit confine displacement of the non-rotatable element to limited axial movement so as to engage the slotted plate under a gravitiational bias. Relative rotation betwen such comminuting elements reduces the size of the material stored thereabove in the hopper as it is drawn into the blower chamber. The comminuted material or particles is thus continuously metered through the slots in the rotating element in surrounding relationship to the inflow air stream entering the blower chamber from the inflow conduit. A downwardly converging conical surface at the upper axial end of the blower rotor guides the feed of comminuted material toward the center of the blower chamber within which it is mixed with the inflowing air and discharged centrifugally from the blower chamber by the fan blades of the blower rotor into the outlet passage.

BRIEF DESCRIPTION OF DRAWING FIGURES

An embodiment of the invention is hereinafter described in greater detail with reference to the accompanying drawings, in which.

DETAILED DESCRIPTION OF SPECIFIC EMBODIMENT

Figure 1:
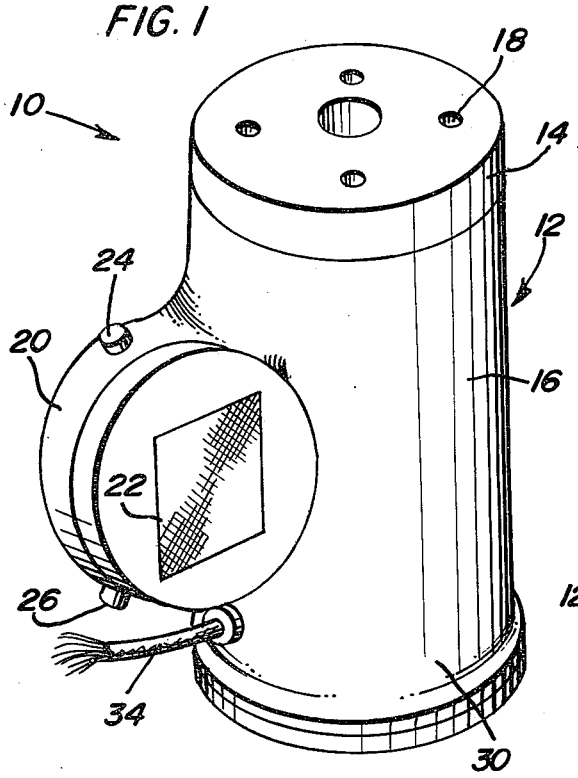
FIG. 1 is a perspective view showing the smoke generating and dispensing device from one side.
Figure 2:
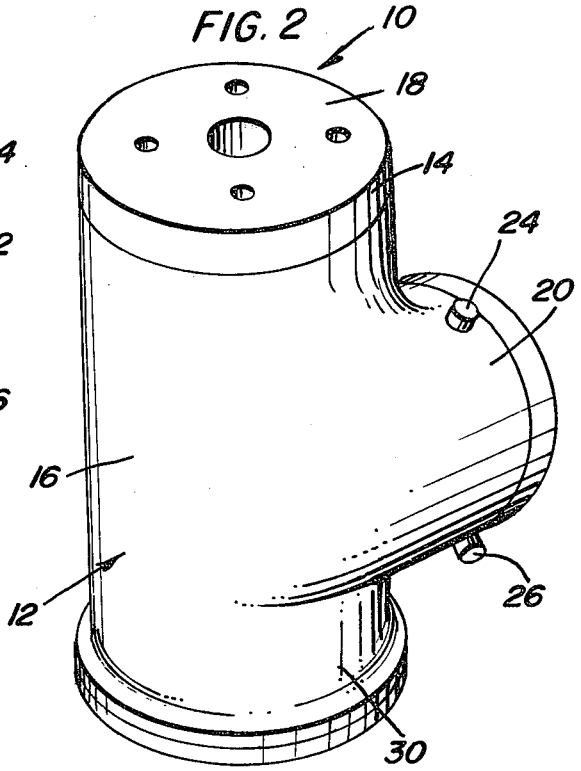
FIG. 2 is a perspective view showing the device from the opposite side of that shown in FIG. 1.

Referring now to the drawings in detail, FIGS. 1 and 2 illustrate a smoke generating and dispensing device constructed in accordance with the present invention and generally referred to by reference numeral 10. The device 10 is shown in a vertically erect position having an axially elongated housing 12. The housing includes a main body portion 16 and an upper end portion 14 having a top wall 18. The main body portion 16 includes a laterally projecting outlet formation 20 from which smoke is discharged at an outlet opening 22 in a direction generally tangential to the generally cylindrical configuration of the housing. Pushbutton controls 24 and 26 are mounted on the laterally projecting formation 20 of the housing above and below the outlet opening 22, respectively, in order to control operation of the device as will be hereinafter explained.

Figure 3:
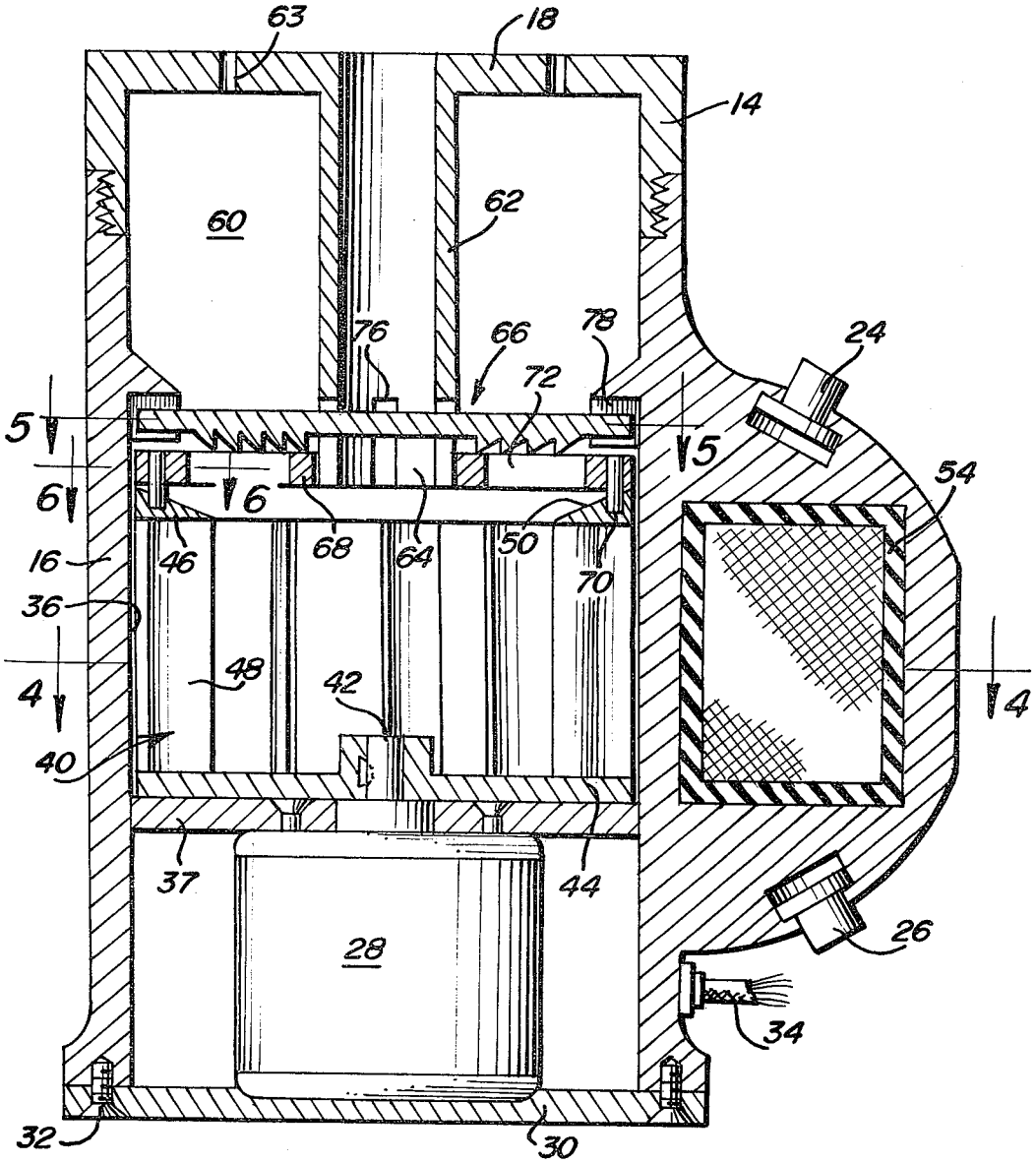
FIG. 3 is a longitudinal section view through the device shown in FIGS. 1 and 2.

Referring now to FIG. 3, in particular, the lower end of the housing encloses a blower motor 28. A closure plate 30 is secured to the housing by fasteners 32 to hold the motor assembled therein. A source of electrical energy for energizing the motor may be connected to the device through an electrical power cable 34. The motor has a power shaft 42 projecting upwardly therefrom into a blower chamber 36 formed within the main body portion 16 of the housing. The blower chamber 36 is separated from the motor chamber by a divider plate 37 and encloses a rotor generally referred to by reference numeral 40 to which the motor shaft 42 is coupled.

Figure 4:
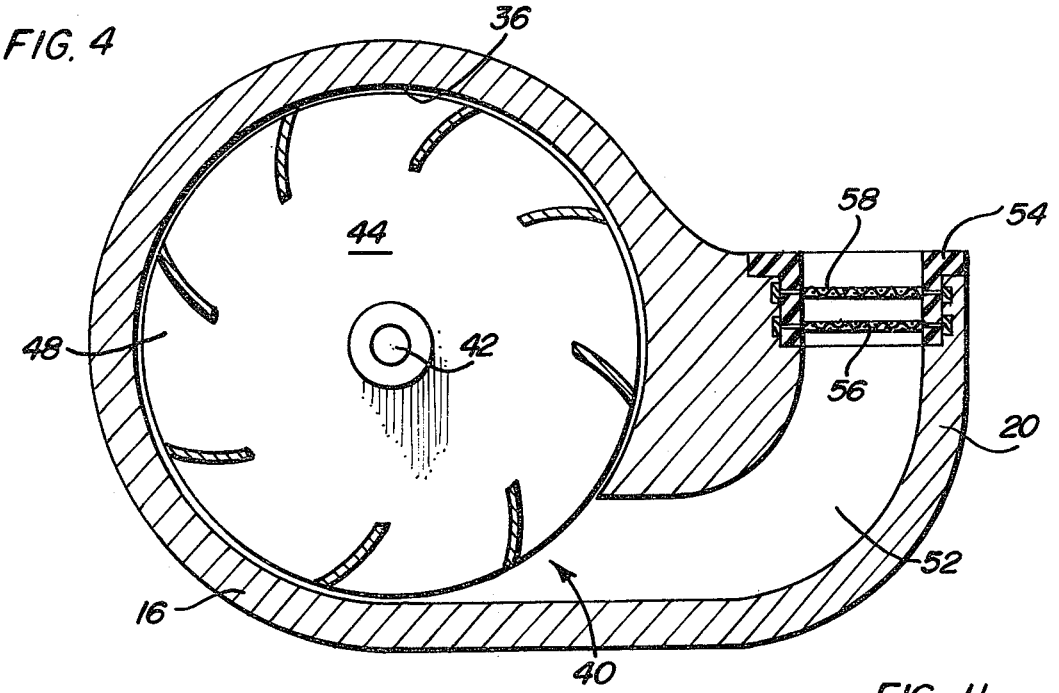
FIG. 4 is a transverse section view taken substantially through a plane indicated by section lines 4—4 in FIG. 3.

As shown in FIGS. 3 and 4, the blower 40 includes a lower disk portion 44 and an upper annular disk portion 46 to which it is connected by a plurality of spiral shaped fan blades 48. The upper annular disk portion 46 of the rotor has a downwardly converging conical surface 50 to guide the down flow of material into a central region of the blower chamber 36 above the lower disk portion 44 from which the fan blades 48 extend radially outward to the circumferential periphery of the rotor in close radially spaced relation to the cylindrical wall surface of the blower chamber.

The laterally extending formation 20 of the housing as shown in FIG. 4 encloses a curved outlet passage 52 that extends tangentially from the cylindrical blower chamber 36. The outlet passage 52 continues through an electrically non-conductive and heat resistant insert duct 54 forming the outlet opening 22. Mounted within the insert is a gas permeable screen 56 made of an electrically conductive material so as to also function as an electrical burner element. A second burner screen element 58 may be mounted in the insert 54 between the opening 22 and the screen 56 of a smaller mesh size. Thus, when the insert 54 is inserted into the formation 20 of the housing, electrical connections from a source of electrical energy are established through switch assembly 24 to opposite electrical terminals of the screen elements 56 and 58 through embedded contacts in the housing or in any other suitable fashion within the skill of the art.

The main body portion 16 of the housing also encloses a hopper chamber 60 located vertically above the blower chamber 36. The hopper chamber is enclosed by the upper end portion 14 of the housing through which an inflow conduit 62 extends downwardly and centrally from end wall 18 terminating at a lower axial end 64 within the blower chamber. Thus, an inflow of ambient air will be conducted by the conduit 62 into the central region of the blower chamber without prior mixing with the material stored in hopper chamber 60. Air may be admitted to the hopper through openings 63 in the end wall 18. If desired, the openings 63 and the conduit 62 may be provided with inflow area adjustment means to regulate the amount of air in excess of that required for combustion.

Figure 6:
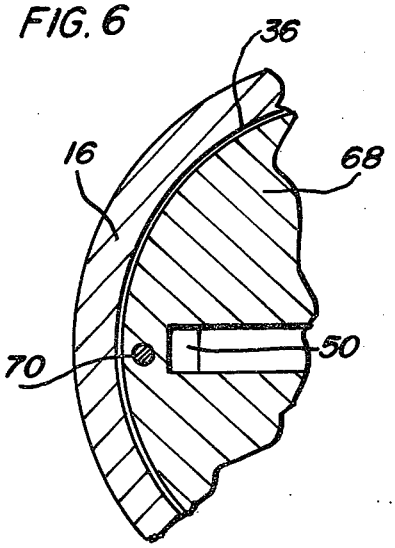
FIG. 6 is a partial section view taken substantially through a plane indicated by section line 6—6 in FIG. 3.
Figure 7:
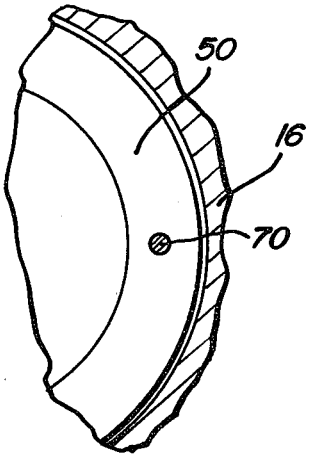
FIG. 7 is a partial section view taken substantially through a plane indicated by section line 7—7 in FIG. 3.

The material in the hopper chamber 60 undergoes comminution as it descends into the blower chamber on to the conical guide surface 50 of the upper annular disk portion 46 of the blower rotor 40. Such comminution of the material is effected by a pair of relatively rotatable comminuting elements generally referred to by reference numerals 66 and 68. The element 68 is a generally planar disk that is coupled to the blower rotor by means of pins 70 as shown in FIGS. 3, 6 and 7. The disk element 68 thus rotates with the rotor at a predetermined speed to effect comminution simultaneously with the operation of the blower. The disk element 68 also partitions the blower chamber 36 from the hopper chamber 60 and is provided with radial feed metering slots 72 through which comminuted material enters the blower chamber in surrounding relation to the inflow airstream emerging from the lower end 64 of the inflow conduit 62. The upper surface of the rotatable comminuting disk 68 is in sliding contact with the other non-rotatable comminuting element 66.

Figure 8:
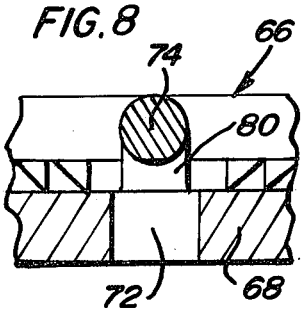
FIG. 8 is an enlarged partial section view taken substantially through a plane indicated by section line 8—8 in FIG. 5.
Figure 5:
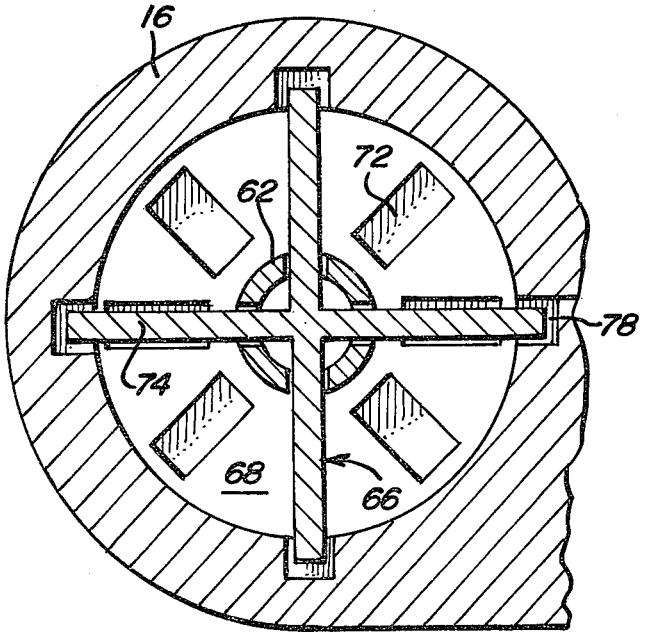
FIG. 5 is a partial transverse section view taken substantially through a plane indicated by section line 5—5 in FIG. 3.

As more clearly seen in FIGS. 3, 5 and 8, the comminuting element 66 includes a plurality of radially extending arms 74 that extend through guide slots 76 formed at the lower end portion of the conduit 62. The radial end portions of the arms 74 are also received in guide slots 78 formed in the body portion 16 of the housing. The slots 76 and 78 thereby prevent rotation of the comminuting element 66 and limit its axial displacement in a vertical direction. Saw-like formations 80 depend from the arms 74 of the comminuting element 66 for contact with the upper surface of the rotating disk element 68. It will therefore be apparent that the element 66 is held in sliding contact with element 68 under a gravitational bias. The element 66 while non-rotatable, is axially displaceable by a limited amount in order to prevent binding and clogging of material during comminution. It should be appreciated that means may be provided for providing a spring bias where gravitational bias is insufficient to produce adequate comminution.

Figure 9:
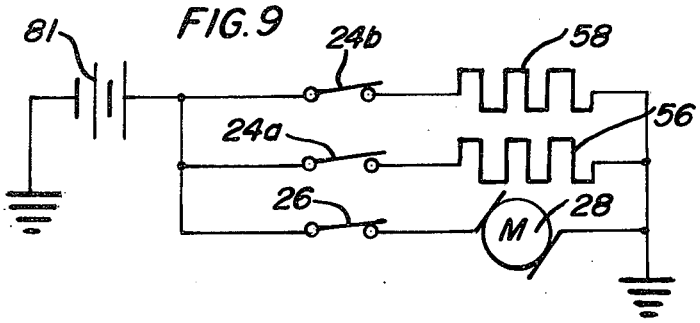
FIG. 9 is a simplified electrical circuit diagram showing the control system associated with the apparatus of FIGS. 1–8.

As shown in FIG. 9, operation of the device 10 may be initiated by closing of pushbutton switch 26 thereby supplying electrical energy to the blower motor 28 from a power source 82 as diagrammatically shown. Operation of the blower will then occur to induce a continuous flow of air that is discharged through the gas permeable screen 56 in the outlet passage 52. At the same time, material drawn from the hopper chamber by suction pressure is comminuted by the cutting action of elements 66 and 68 to enable a metered quantity of solid particles to continuously descend into the blower chamber and be carried by the air flow stream into the outlet passage 52. The particles are, however, too large to pass through the screen 56 and will accumulate on its upstream side to restrict continued air flow therethrough. A build up of pressure in the outlet passage 52 therefore occurs. When an appropriate amount of particulate material is accumulated in the outlet passage 52, the switch 24 is selectively actuated to close either switch section **24*a* or both switch sections 24*a* and 24*b* in order to energize the burner elements 56 and 58 thereby producing combustion of the particles in passage 52 at the desired rate. The combustion products or smoke so produced are displaced under the pressure in passage 52 through the screen 56 resulting in the discharge of smoke from the outlet opening 22**.

Figure 10:
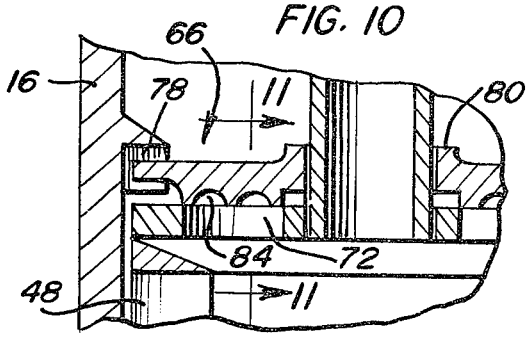
FIG. 10 is a partial section view corresponding to that of FIG. 3 showing a modification.
Figure 11:
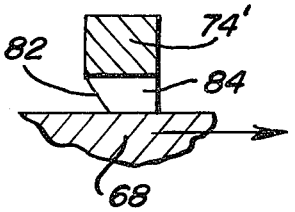
FIG. 11 is an enlarged partial section view taken substantially through a plane indicated by section line 11—11 in FIG. 10.

FIG. 10 shows a modified form of comminuting element 66' having arm 74' extending radially from an annular hub portion 80 through which an inflow conduit 62' projects. The arms 74' are rectangular in cross-section as shown in FIG. 11 except for a trailing bevel 82. The sliding surface of the arms is also provided with slots 84. Otherwise, the element 66' is the same as element 66 as hereinbefore described.

Figure 12:
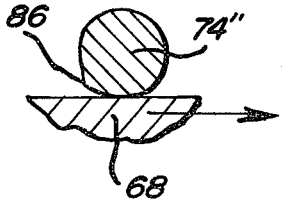
FIG. 12 is a partial section view corresponding to FIG. 11, showing another modification.

Another modification is shown in FIG. 12 wherein the cross-section of the element arms 74'' are circular except for a chordal portion 86 in which spaced slots are formed. The slots in chordal portion 86 form rearwardly inclined bevels on the trailing side as shown.

Figure 13:
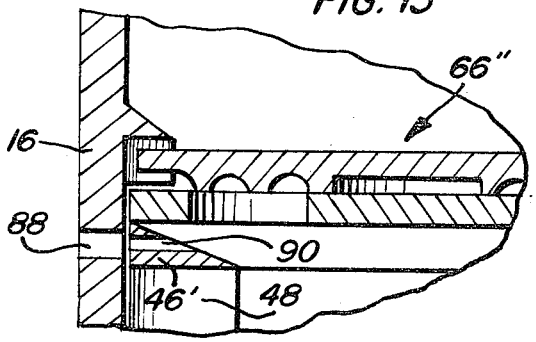
FIG. 13 is a partial section view similar to FIG. 10, but showing yet another modification.

FIG. 13 illustrates a modification in which the inflow of air to the blower chamber is conducted through inlet openings 80 spaced circumferentially about the housing section 16. The inflow of air enters the blower chamber through radial passages 82 formed in the upper annular disk portion 46' of the blower blade assembly. In this embodiment, the inflow conduit 62 may be eliminated.

What is claimed is:

1. In an apparatus for generating and dispensing smoke by combustion of material on an upstream side of a gas permeable element through which a flow stream is induced by a blower, the improvement residing in a housing having a portion within which said gas permeable element is mounted downstream of the blower, a hopper within which the material is stored upstream of the blower, means for introducing the material from the hopper into the blower and an inflow conduit extending through the hopper to the blower through which ambient air is conducted to the blower separately from the material entering the blower from the hopper through the material introducing means.

2. The improvement as defined in claim 1 including means for comminuting the material entering the blower.

3. The improvement as defined in claim 2 wherein sid comminuting means includes a pair of relatively rotatable elements, guide means for limiting displacement of one of the elements into and out of sliding contact with the other of the elements, and means for exerting a bias on said one of the elements toward sliding contact with the other of the elements.

4. The improvement as defined in claim 3 wherein said other of the elements is rotatable with the blower and partitions the blower from the hopper.

5. The improvement as defined in claim 4 wherein said other of the elements is a disk having radially extending slots.

6. The improvement as defined in claim 3 wherein said other of the elements is a disk having radially extending slots.

7. In an apparatus for generating and dispensing smoke by combustion of material on an upstream side of a gas permeable element through which a flow stream is introduced by a blower, the improvement residing in a housing enclosing a hopper within which the material is stored upstream of the blower, means for introducing the material from the hopper into the blower, and means for comminuting the material entering the blower from the hopper through the material introducing means, said comminuting means including a pair of relatively rotatable elements, guide means for limiting displacement of one of the elements into and out of sliding contact with the other of the elements, and means for exerting a continuous bias on said one of the elements toward sliding contact with the other of the elements.

8. The improvement as defined in claim 7 wherein said other of the elements is a disk having radially extending slots.

9. The improvement as defined in claim 7 wherein said one of the elements includes a plurality of radial arms having a slotted contact surface in sliding contact with the other of the elements.

10. The improvement as defined in claim 9, wherein said contact surface is formed by saw-like teeth.

11. The improvement as defined in claim 9 wherein the arms are cross-sectionally formed with trailing bevels extending upwardly from the contact surface.

12. The improvement as defined in claim 11 wherein said arms are circular in cross-section except along chordal portions at which the bevels are formed.

13. Appartus for continuously generating smoke for different uses, which apparatus comprises: a housing containing a chamber for holding particulate material and a chamber in which smoke is generated, means for continuously feeding the particulate material into said smoke generating chamber, heating means within said smoke generating chamber to ignite the particulate material fed thereinto, blower means for supplying air into said smoke generating chamber to the particulate material sufficient to maintain combustion, duct means for exhaust of the smoke produced in said smoke generating chamber from said chamber, the continuous feeding means including a rotatable element through which gravitational infeed of the material from the holding chamber to the smoke generating chamber occurs, and means mounting the blower means in operative relation to the chambers for enhancing said gravitational infeed of the material and the exhaust of the smoke by the duct means in response to inflow of the air to the smoke generating chamber.

14. Apparatus in accordance with claim 13, wherein said holding chamber is located above said smoke generating chamber, the two chambers being separated by a barrier, said barrier having an opening extending from the bottom of the holding chamber to a cylindrical cavity in the barrier, which cavity extends to the smoke generating chamber, the cavity having said rotatable element therein and said continuous feeding means further including means rotating said rotatable element at a predetermined rotational speed for continuously feeding the material into the smoke generating chamber at a desired rate.

15. The apparatus of claim 13, wherein the rotatable element is connected to the blower means and rotatable therewith, said element having at least one opening therein through which the material in the holding chamber passes to the smoke generating chamber through the blower means.

16. The apparatus of claim 13 wherein said blower means includes a blower chamber located by the blower mounting means between the holding and smoke generating chambers.

* * * * *